US010727579B2

(12) United States Patent
Wu et al.

(10) Patent No.: US 10,727,579 B2
(45) Date of Patent: Jul. 28, 2020

(54) DEVICE AND METHOD OF REDUCING MUTUAL COUPLING OF TWO ANTENNAS BY ADDING CAPACITORS ON GROUND

(71) Applicant: The Chinese University of Hong Kong, Shatin (CN)

(72) Inventors: Ke-Li Wu, Shatin (CN); Jiangwei Sui, Henan (CN); Dacheng Wei, Guangzhou (CN)

(73) Assignee: The Chinese University of Hong Kong, Shatin, N.T. (HK)

( * ) Notice: Subject to any disclaimer, the term of this patent is extended or adjusted under 35 U.S.C. 154(b) by 98 days.

(21) Appl. No.: 16/054,288

(22) Filed: Aug. 3, 2018

(65) Prior Publication Data

US 2020/0044329 A1 Feb. 6, 2020

(51) Int. Cl.

| | |
|---|---|
| ***H01Q 1/52*** | (2006.01) |
| ***H01Q 1/48*** | (2006.01) |
| ***H01Q 1/24*** | (2006.01) |
| ***H01Q 21/08*** | (2006.01) |

(52) U.S. Cl.

CPC ..... *H01Q 1/521* (2013.01); *H01Q 1/243* (2013.01); *H01Q 1/48* (2013.01); *H01Q 21/08* (2013.01)

(58) Field of Classification Search

CPC ..... H01Q 1/52; H01Q 1/521

See application file for complete search history.

(56) References Cited

U.S. PATENT DOCUMENTS

| | | | | |
|---|---|---|---|---|
| 7,629,930 | B2 | 12/2009 | Murch et al. | |
| 8,085,202 | B2 | 12/2011 | Ayatollahi et al. | |
| 9,203,139 | B2 | 12/2015 | Zhu et al. | |
| 9,203,144 | B2 | 12/2015 | De Luis et al. | |
| 9,543,644 | B2 | 1/2017 | Wu et al. | |
| 9,774,079 | B2 | 9/2017 | Liu | |
| 2008/0252536 | A1* | 10/2008 | Anguera | H01Q 1/243 343/702 |
| 2015/0138036 | A1* | 5/2015 | Harper | H01Q 1/48 343/848 |
| 2015/0255865 | A1 | 9/2015 | Nishimoto et al. | |
| 2016/0226139 | A1* | 8/2016 | Yu | H01Q 1/521 |

(Continued)

OTHER PUBLICATIONS

Chen et al. "A decoupling technique for increasing the port isolation between two strongly coupled antennas." IEEE Transactions on Antennas and Propagation 56, No. 12 (Dec. 2008): 3650-3658.

(Continued)

*Primary Examiner* — Daniel Munoz

(74) *Attorney, Agent, or Firm* — Kilpatrick Townsend & Stockton LLP

(57) ABSTRACT

Radio frequency antennas sharing a ground plane are largely decoupled using one or more lumped capacitive elements set into holes within the ground plane. The holes, which are precisely placed, can extend to a side of the ground plane. A stub extends from a fringe of the hole either straight or bending in an L shape, and a capacitor connects between an end of the stub and another side of the hole. Capacitive elements can also be supported on raised solder pads above a ground plane or off to one side of the ground plane. Methods for manufacturing the decoupling apparatus are described.

30 Claims, 12 Drawing Sheets

(56) References Cited

U.S. PATENT DOCUMENTS

| | | | | |
|---|---|---|---|---|
| 2018/0083367 | A1* | 3/2018 | Song | H01Q 1/48 |
| 2018/0108984 | A1 | 4/2018 | Wu et al. | |

OTHER PUBLICATIONS

Qian et al. "An LTCC coupled resonator decoupling network for two antennas." IEEE Transactions on Microwave Theory and Techniques 63, No. 10 (Oct. 2015): 3199-3207.
Sui et al. "Self-Curing Decoupling Technique for Two Inverted-F Antennas With Capacitive Loads." IEEE Transactions on Antennas and Propagation 66, No. 3 (Mar. 2018): 1093-1101.
Tang et al. "Dual-band decoupling and matching network design for very closely spaced antennas." In Microwave Conference (EuMC), 2012 42nd European, pp. 49-52. IEEE, Oct. 29-Nov. 1, 2012.
Wu et al. "Array-antenna decoupling surface." IEEE Transactions on Antennas and Propagation 65, No. 12 (Dec. 2017): 6728-6738.
Zhao et al. "A cascaded coupled resonator decoupling network for mitigating interference between two radios in adjacent frequency bands." IEEE Transactions on Microwave Theory and Techniques 62, No. 11 (Nov. 2014): 2680-2688.

* cited by examiner

DEVICE AND METHOD OF REDUCING MUTUAL COUPLING OF TWO ANTENNAS BY ADDING CAPACITORS ON GROUND

CROSS-REFERENCES TO RELATED APPLICATIONS

Not Applicable

STATEMENT AS TO RIGHTS TO INVENTIONS MADE UNDER FEDERALLY SPONSORED RESEARCH AND DEVELOPMENT

Not Applicable

BACKGROUND

1. Field of the Invention

The present application generally relates to means for reducing coupling between antennas. Specifically, the application is related to the placement of lumped capacitive elements upon structures inset within, protruding above, or protruding from a ground plane shared by different antennas in order to reduce mutual coupling between the antennas.

2. Description of the Related Art

Multiple-input and multiple-output, or MIMO, technology has been widely used in today's wireless communication systems, from base stations to Wi-Fi modules and various mobile terminals such as smart phones and tablets. It has become an essential component of industry standards, not only in IEEE 802.11n and LTE 4G, but also in 5G wireless systems. By using multiple antennas, a MIMO system sends and receives more than one data signal stream simultaneously over the same radio channel by utilizing uncorrelated channel paths in a multipath environment.

One of the issues to accommodate the high demands of a high number of antennas on a smart phone is how to reduce the mutual coupling among tightly packed antennas that are attached to a compact circuit board, which is full of densely populated surface mounted electronic components. A common design scenario is that space for antennas is very limited. There are mainly three basic types of antennas commonly seen on wireless terminals: inverted-F antennas (IFAs), monopole antennas, and loop antennas. Mutual coupling is inevitable among antennas regardless of antenna type. It has been well understood that mutual coupling will significantly degrade the data throughput in a MIMO system. The impact of mutual coupling can be attributed by three factors: (1) it lowers the total efficiency of the antenna array as the coupled antenna dissipates the coupled energy; (2) it increases the correlation of different channels and deteriorates the MIMO performance; and (3) it decreases the signal-to-noise (S/N) ratio of each communication channel. Research also reveals that a coupled signal also degrades the linearity of the power amplifier in the victim channels.

There is a need in the art for reducing mutual coupling between antennas in smart phones and other wireless terminals.

BRIEF SUMMARY

Generally, one or more decoupling capacitors are inlaid within, set above, or extended from the perimeter of a ground plane that is shared by antennas. The decoupling capacitors are placed at "acupoints" in the ground plane. Each capacitor acts as a coherent current source that generates an interference signal that is of the same magnitude but opposite phase as the coupled signal at the coupled antenna port, resulting in mutual coupling cancellation. The x, y positions of the acupoints are within 0.2λ of a feeding port or a shorting end of the offending antenna.

Each capacitor extends between a stub, a small protrusion of conductive material, from the ground plane, back to the ground plane. No feature of the stub, or aperture in which it is set, has a dimension longer than 0.1λ, making the stub electrically small or shallow.

Within these parameters the capacitance of the lumped capacitor can be optimized using electromagnetic (EM) simulation software.

Some embodiments of the present invention are related to an antenna decoupling apparatus for antennas that share a ground plane. The apparatus includes a first antenna having an operative wavelength λ, a second antenna, a ground plane connecting the first antenna and the second antenna, the ground plane having an aperture located within 0.2λ of a feeding port or a shorting end of the first antenna, the aperture having no continuous edge longer than 0.1λ, a stub extending from a first edge of the aperture, and a discrete capacitor connecting the stub to a second edge of the aperture.

The aperture can be a reentrant opening extending from a periphery of the ground plane. The ground plane can have a second aperture located within 0.2λ of a feeding port or a shorting end of the second antenna, the second aperture having no continuous edge longer than 0.1λ. The apparatus can further include a second stub extending from a first edge of the second aperture, and a second discrete capacitor connecting the second stub to a second edge of the second aperture. The second aperture can be a reentrant opening extending from a periphery of the ground plane.

Either antenna can be an inverted F antenna (IFA), and the aperture can be located within 0.2λ of a shorting end of the IFA. The stub can be L-shaped and the second edge of the aperture inward, away from a nearest edge of the ground plane.

Either antenna can be a bent monopole antenna, and the aperture can be located within 0.2λ of a feeding port of the bent monopole antenna. The stub can be rectangular and extend parallel with a nearest edge of the ground plane.

Either antenna can be a loop antenna, and the aperture can be located within 0.2λ of a feeding port of the loop antenna. The stub can be L-shaped and the second edge of the aperture be inward, away from a nearest edge of the ground plane.

The first and/or second antenna can be an inverted F antenna (IFA), monopole antenna, or loop antenna. The first antenna or the second antenna can comprise a metal frame of a mobile electronic device. The discrete capacitor can be a variable capacitor. The discrete capacitor can be a surface mount device (SMD) capacitor. Another discrete capacitor can be in parallel with the first capacitor. The apparatus can include a printed circuit board (PCB) dielectric supporting the ground plane, first antenna, and second antenna and filling the aperture. The discrete capacitor can be directly connected to the ground plane at the second edge of the aperture. The discrete capacitor can be connected at an end of the stub.

The first and second antennas can share operating frequency bands or be in two adjacent frequency bands. The first and/or second antenna can operate in a long-term evolution (LTE) band frequency between 2.11 GHz and 2.17

GHz and thus has an operative wavelength λ between 142 mm and 138 mm, or an industrial, scientific, and medical (ISM) frequency between 2.400 GHz and 2.4835 GHz and thus has an operative wavelength λ between 125 mm and 121 mm, or a global positioning system (GPS) L1 frequency at 1.57542 GHz (L1) and L2 frequency at 1.22760 GHz and thus has an operative wavelength λ of 190 mm or 244 mm.

Some embodiments are related to an antenna decoupling apparatus for antennas that share a ground plane. The apparatus can include a first antenna having an operative wavelength λ, a second antenna, a ground plane connecting the first antenna and the second antenna, a protrusion extending no more than 0.1λ from the ground plane and being located within 0.2λ of a feeding port or a shorting end of the first antenna, and a discrete capacitor connecting the protrusion to the ground plane within 0.2λ of the feeding port or the shorting end of the first antenna.

There can be a second protrusion extending no more than 0.1λ from the ground plane and being located within 0.2λ of a feeding port or a shorting end of the second antenna, and a second discrete capacitor connecting the second protrusion to the ground plane within 0.2λ of the feeding port or the shorting end of the second antenna. The protrusion can include a soldering pad raised above the ground plane. The protrusion can include a stub extending laterally in a same plane as the ground plane.

Some embodiments are related to an antenna decoupling apparatus for antennas that share a ground plane. The apparatus can include a first antenna having an operative wavelength λ1, a second antenna having an operative wavelength λ2, a ground plane connecting the first antenna and the second antenna, a first discrete capacitor located within 0.2 λ1 of a feeding port or a shorting end of the first antenna and having both terminals electrically shorted with the ground plane, and a second discrete capacitor located within 0.2 λ2 of a feeding port or a shorting end of the second antenna and having both terminals electrically shorted with the ground plane.

The operative wavelength λ1 can be between 600 mm and 60 mm, or corresponding frequencies of 0.5 GHz and 5 GHz, and a capacitance of the first capacitor can be between 0.56 pF and 10 pF.

Some embodiments are related to a method for reducing coupling between a first antenna and a second antenna that share a ground plane. The method includes forming an aperture in the ground plane within 0.2λ of a feeding port or a shorting end of the first antenna, the aperture having no continuous edge longer than 0.1λ, fashioning a stub extending from a first edge of the aperture, and soldering a discrete capacitor to the stub and connecting the discrete capacitor to a second edge of the aperture.

The aperture can be a reentrant opening extending from a periphery of the ground plane. The method can include forming a second aperture in the ground plane within 0.2λ of a feeding port or a shorting end of the second antenna, the second aperture having no continuous edge longer than 0.1λ, fashioning a second stub extending from a first edge of the second aperture, and soldering a second discrete capacitor to the second stub and connecting the second stub to a second edge of the second aperture of the ground plane. The second aperture can be a reentrant opening extending from a periphery of the ground plane. The method can further include modeling the dimensions of the first and second antennas, ground plane, aperture, and stub using electromagnetic (EM) simulation software, and selecting a capacitance of the discrete capacitor based on the modeling. The method can include providing a printed circuit board (PCB) dielectric, and milling or etching metal on the PCB for the forming and fashioning.

DETAILED DESCRIPTION

In general, what is described is a self-curing decoupling scheme for two or more antennas that share a ground plane. One or more capacitors that are inlaid within, above, or alongside the ground plane creates an incremental current on top of that of original coupled antennas. The interference signal generated by the incremental current is of the same magnitude but opposite phase as that of the coupled signal so that the coupled signal is canceled out at the victim port. A numerical electromagnetic (EM) simulation of the configuration can be used to select the capacitances of the capacitors and fine tune the configuration.

Technical advantages of this self-curing decoupling scheme are many. For example, there does not need to be a direct physical connection or obstruction between coupled antennas. It requires negligible real-estate. It is versatile for virtually all of the commonly used antennas on wireless terminals. The scheme tends to improve the matching conditions of the decoupled antennas without needing any extra impedance matching circuit. It is highly flexible in implementation as the electrically small decoupling capacitors are detached from the antennas. And the design method can be potentially extended to multiple-input, multiple output (MIMO) antenna arrays with more than two antenna elements. These and other advantages can be found in some embodiments described herein.

Figure 1:
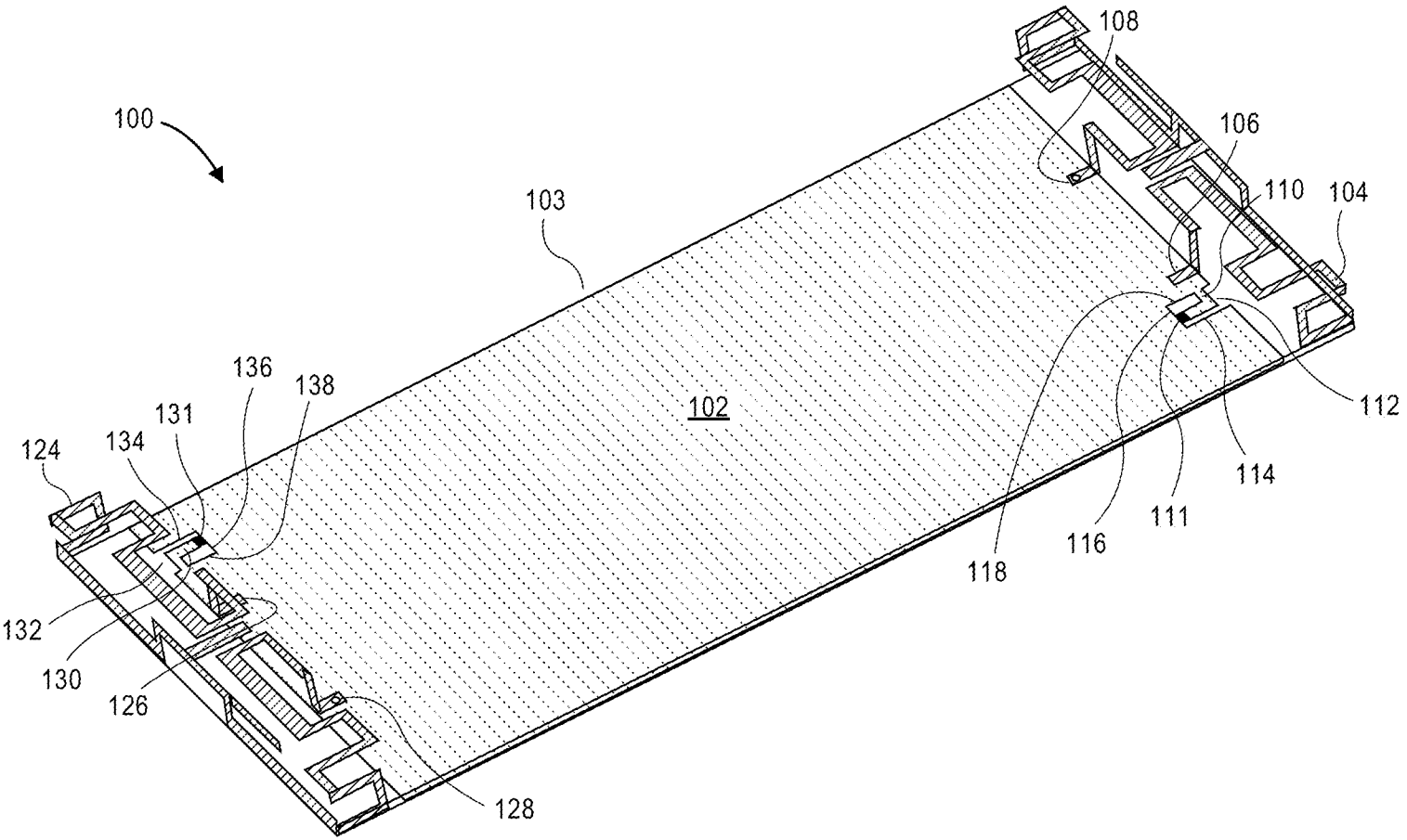
FIG. 1 is an isometric view of antennas on a smart phone ground plane with inlaid decoupling apparatus in accordance with an embodiment.

FIG. 1 is an isometric view of a system 100 of two antennas 104 and 124 on a smart phone ground plane 102 with inlaid decoupling apparatus 103.

On one end of ground plane 102, loop antenna 104 extends from feeding port 106 and meanders around to shorting point 108, which is electrically connected to ground plane 102. Loop antenna has a nominal frequency or frequency range, for which a nominal wavelength λ can easily be computed from frequency f by the equation λ=c/f, where c is the speed of light. The speed of light in a vacuum is 299,792,458 meters per second.

In some embodiments, the antennas can be part of the metal frame of a smart phone or other mobile electronic device.

Near feeding port 106, ground plane 102 has L-shaped stub 110, capacitor 111, and reentrant aperture 112. They are all within 0.2λ of feeding port 106. Being close to the feeding port exposes the stub and capacitor to stronger currents from the ground plane than if they were further away from the feeding port. Using the stronger currents, the stub and capacitor perturb the current distribution on the ground plane and equivalently create a coherent current source. The coherent current source generates a signal at the victim port with the same magnitude but opposite phase as that of the coupled signal to mitigate the mutual coupling. Stubs and/or capacitors within 0.01λ, 0.5λ, 0.10λ, 0.15λ, and 0.20λ of a feeding port or ground port are suitable. Stubs and/or capacitors within 0.25λ, 0.30λ, 0.35λ, 0.40λ, 0.45λ, and 0.50λ of a feeding port or ground port of an antenna may be suitable.

A "reentrant" opening or aperture includes a slot, channel, or other opening that extends inward from an edge of an item, or as otherwise known in the art.

Aperture 112 includes edges 114, 116, and 118. The combined total length of edges 114, 116, and 118, along with the edges of stub 110, which form a continuous edge, is less than 0.1λ. This is electrically very small, such that the introduction of the aperture to the ground plane does not change the antenna characteristics. The magnitude and phase of S-parameters of the coupled antennas are not changed noticeably. This would likely be different for apertures on the order of ¼ λ and greater. Thus, apertures with no continuous edge longer than 0.01λ, 0.05λ, 0.10λ, are suitable. Apertures with no continuous edge longer than 0.15λ, and 0.20λ may be suitable.

Stub 110 extends from edge 118 of the aperture and turns inward toward the center of the ground plane. The right angle turn forms an L shape. The portion of stub 110 that extends from edge 118 is not even, or aligned, with the outer edge of ground plane 102. Instead, it is slightly inset from the perimeter. This inset distance can be zero to align them; however, making it non-zero, as shown here, gives one freedom to tune the decoupling effect.

Discrete capacitor 111, a lumped capacitive element, connects from stub 110 to edge 116. It connects from an end of stub 110 but may connect from another portion of the stub.

In some embodiments, multiple discrete capacitors in parallel may be used instead of a single discrete capacitor. This may give additional design room for achieving a desired capacitance.

On the opposite end of ground plane 102, another loop antenna 124 extends from feeding port 126 and meanders around to shorting point 128, which is electrically connected to ground plane 102. This second loop antenna has a nominal frequency or frequency range, for which there is a nominal wavelength λ2.

Near feeding port 126, ground plane 102 has L-shaped stub 130, capacitor 131, and reentrant aperture 132. They are all within 0.2 λ2 of feeding port 126 but can be within 0.01 λ2, 0.05 λ2, 0.10 λ2, 0.15 λ2, 0.25 λ2, 0.30 λ2, 0.35 2λ, 0.40 λ2, 0.45 λ2, and 0.50 λ2 of the feeding port in other embodiments.

Aperture 132 includes edges 134, 136, and 138. The combined total length of edges 134, 136, and 138, along with the edges of stub 130, which form a continuous edge, is less than 0.1 λ2. In other embodiments, apertures with no continuous edge longer than 0.01 λ2, 0.05 λ2, 0.15 λ2, and 0.20 λ2 may be suitable.

Stub 130 extends from edge 138 of the aperture and turns inward toward the center of the ground plane. The right angle turns create an L shape. Like the other stub, the portion of stub 130 that extends from edge 138 is not even with the outer edge of ground plane 102.

Discrete capacitor 131, a lumped capacitive element, connects from stub 130 to edge 136. It connects from an end of stub 130 but may connect from another portion of the stub.

Inlaid capacitor 111 is positioned at particular x, y coordinate, an "acupoint," on ground plane 102. In theory, the position of the acupoint, along with the features of the connecting stub, uses the electrical energy near feeding port 106 for antenna 104 and slightly delays it to form another signal on the ground plane. This signal is akin to a current source. This signal ends up at the victim port, feeding port 126 of antenna with the same magnitude but opposite phase as that of the coupled signal between antennas 104 and 124, resulting in mutual coupling cancellation.

In some embodiments, the discrete capacitor can be a variable capacitor for tuning the decoupling apparatus. It can be a surface mount device (SMD), and/or the capacitor can include two or more capacitors in parallel with a first capacitor.

Figure 2A:
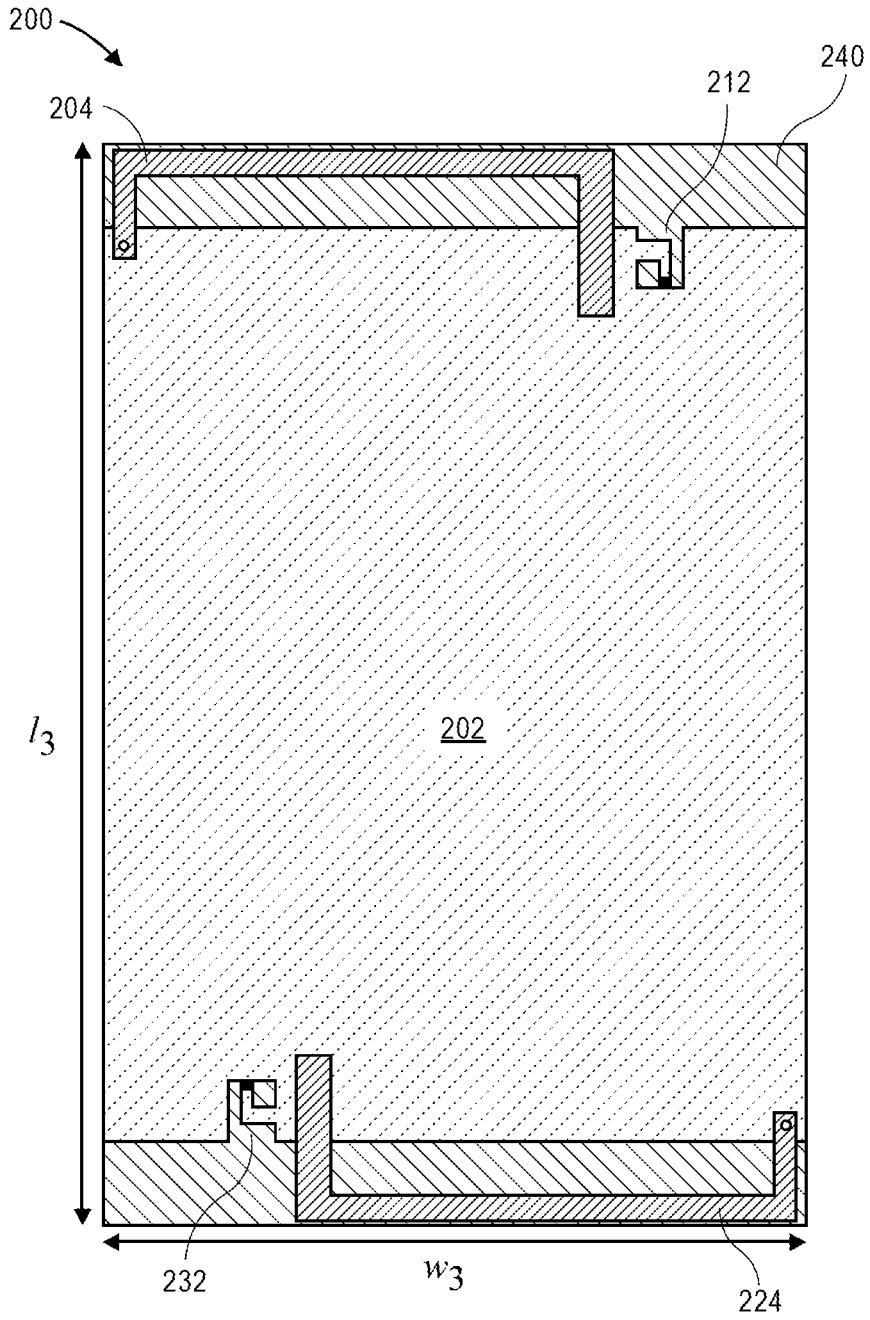
FIG. 2A is a top view of loop antennas with decoupling apparatus inlaid within a ground plane in accordance with an embodiment.
Figure 2B:
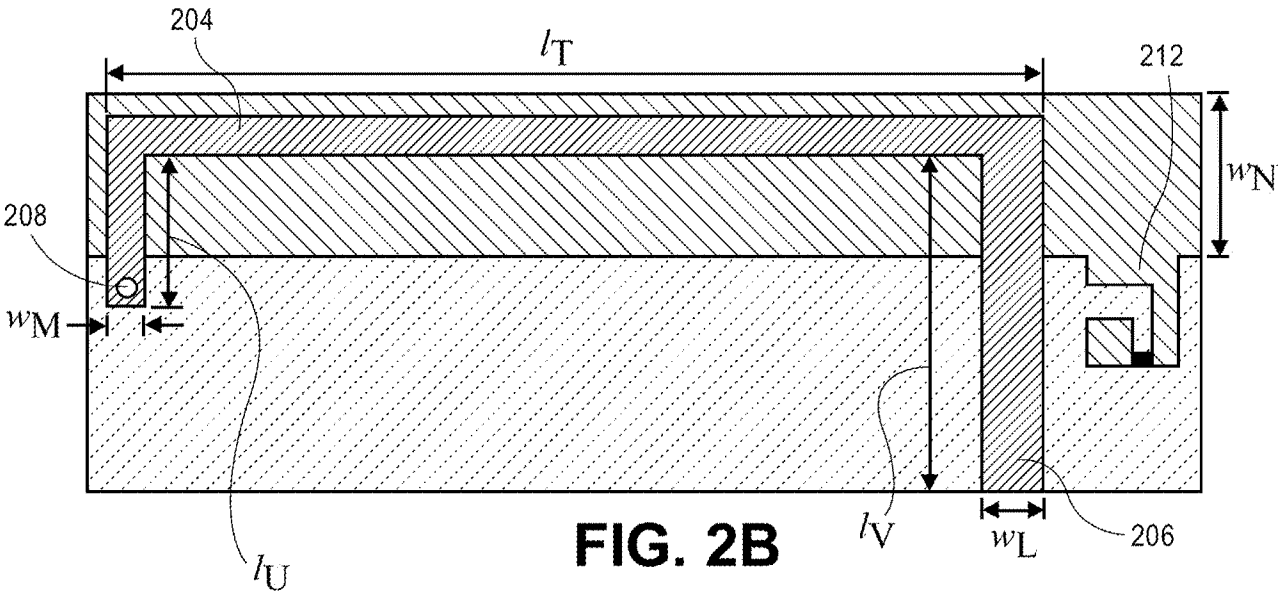
FIG. 2B is a close in view of one of the antennas and decoupling apparatus of FIG. 2A.
Figure 2C:
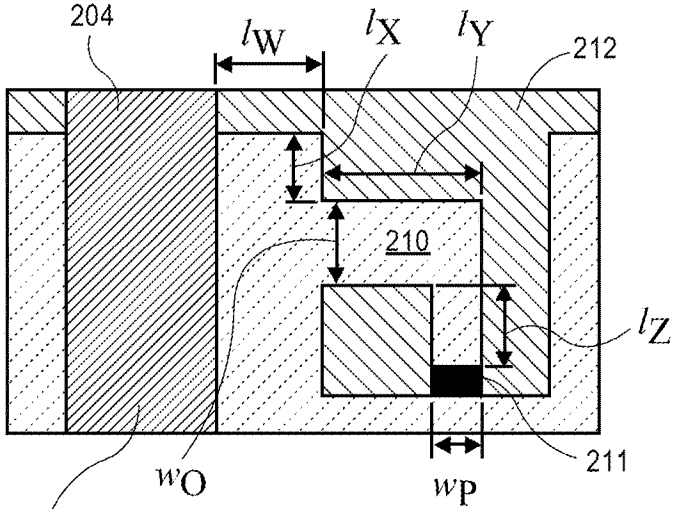
FIG. 2C is a close in view of the decoupling apparatus of FIG. 2B.

The antennas can share operating frequency bands, be in adjacent frequency bands, or a mixture of the two. As common in some mobile devices, the antennas can operate in a long-term evolution (LTE) band frequency between 2.11 GHz and 2.17 GHz and thus has an operative wavelength λ between 142 mm and 138 mm, operate in an industrial, scientific, and medical (ISM) frequency between 2.400 GHz and 2.4835 GHz and thus has an operative wavelength λ between 125 mm and 121 mm, and/or operate in a global positioning system (GPS) L1 frequency at 1.57542 GHz (L1) and L2 frequency at 1.22760 GHz and thus has an operative wavelength λ of 190 mm or 244 mm FIGS. 2A-2C illustrate loop antennas with decoupling apparatus inlaid within a ground plane. A loop antenna is a commonly-used antenna form in mobile terminals. It is well known that loop antennas are less vulnerable to the body proximity effect because the current induced on the ground plane is weak.

In FIG. 2A, system 200 has two identical loop antennas 204 and 224 placed antisymmetrically on two opposite edges of a printed circuit board (PCB). Reentrant openings 212 and 232 are made in ground plane 202. Antennas 204 and 224 are supported by ground plane 202 and dielectric 240 that extends laterally from edges of the ground plane.

FIG. 2B is a close up view of the antenna 204 with reentrant opening 212 to one side. A leg of antenna 204 connects to feeding port 206, and an opposite leg connects directly to ground plane 202 through shorting point 208.

FIG. 2C is a further close up of the right side of antenna 204 and feeding port 206 with aperture 212 nearby. Stub 210 projects from the side of the aperture nearest feeding port 206 and then turns downward toward the center of the ground plane. Capacitor 211 connects an end of stub 210 to an edge of the aperture.

The dimensions of the exemplary loop antenna as well as a reentrant opening for inlaying a decoupling capacitor are marked with reference identifiers $l_3$, $w_3$, and $l_T$–$l_Z$ and $w_L$–$w_P$. Specific values are shown in Table 1.

With the specific numerical dimensions in the table, two decoupling capacitors with a value of 1.1 pF have been experimentally shown to improve isolation between the loop antennas from about 14 to 26 dB at 2.14 GHz and the matching condition is almost untouched.

As summarized in Table 2, the measured total efficiencies at 2.14 GHz is improved from 50 to 54% after decoupling. The average throughputs for the LTE module with the coupled and decoupled loop antennas are measured under the UMi and UMa environments, respectively. In the UMi channel environment, when throughput drops 10% from the maximum value of 14.386 Mbps, about 0.6 dB or 13% of power saving, can be achieved after decoupling. Similarly, under the UMa channel environment, about 1.2 dB power saving can be achieved when the throughput drops from the maximum value 14.386 Mbps to 13 Mbps. Similar to the case of IFAs and monopole antennas, the shape of radiation patterns does not change significantly after decoupling.

TABLE 1

Dimensional values for different antenna cases. Units are in millimeters (mm).

| | | | | | | | | | | | | |
|---|---|---|---|---|---|---|---|---|---|---|---|---|
| Inverted-F Antennas | $l_1$ | $l_A$ | $l_B$ | $l_C$ | $l_D$ | $l_E$ | $l_F$ | $l_G$ | $l_H$ | $l_I$ | $l_J$ | $l_K$ |
| | 100 | 19 | 6.5 | 4.5 | 5 | 20 | 12 | 9 | 2.5 | 1 | 2.5 | 2.3 |
| | $l_L$ | $w_1$ | $w_A$ | $w_B$ | $w_C$ | $w_D$ | $w_E$ | $w_F$ | | | | |
| | 1.5 | 65 | 3.1 | 3 | 2 | 10 | 1.2 | 1 | | | | |
| Monopole Antennas | $l_2$ | $l_M$ | $l_N$ | $l_O$ | $l_P$ | $l_Q$ | $l_R$ | $l_S$ | $w_2$ | $w_G$ | $w_H$ | $w_I$ |
| | 120 | 19 | 6 | 28 | 11 | 1.8 | 1 | 3 | 70 | 3.1 | 2 | 10 |
| | $w_J$ | $w_K$ | | | | | | | | | | |
| | 1.2 | 1.7 | | | | | | | | | | |
| Loop Antennas | $l_3$ | $l_T$ | $l_U$ | $l_V$ | $l_W$ | $l_X$ | $l_Y$ | $l_Z$ | $w_3$ | $w_L$ | $w_M$ | $w_N$ |
| | 120 | 51.7 | 7.2 | 23 | 2.5 | 1 | 3.7 | 2.1 | 75 | 3.1 | 2 | 7 |
| | $w_O$ | $w_P$ | | | | | | | | | | |
| | 1.7 | 1.5 | | | | | | | | | | |

TABLE 2

| Antenna | Passive Test | | | | | | MIMO OTA Test | |
|---|---|---|---|---|---|---|---|---|
| | Isolation | | Impedance Matching | Total Efficiency | | Radiation Pattern | MARSS reduction in UMi | MARSS reduction in UMa |
| Types | Coupled | Decoupled | Change | Coupled | Decoupled | Change | Model | Model |
| IFA | 12 dB | 29 dB | Small | 68% | 75% | Small | 0.5 dB for 64 QAM | 0.3 dB for 16 QAM |
| Monopole | 7 dB | 30 dB | Small | 57% | 73% | Small | 0.4 dB for 64 QAM | 0.9 dB for 16 QAM |
| Loop | 14 dB | 26 dB | Small | 50% | 54% | Small | 0.6 dB for 16 QAM | 1.2 dB for 16 QAM |

*The isolation and total efficiency is compared at 2.14 GHz and the MIMO average radiated SIR sensitivity (MARSS) reduction in the over-the-air (OTA) test is operated in the 10 MHz band (2.135-2.145 GHz).

Figure 3A:
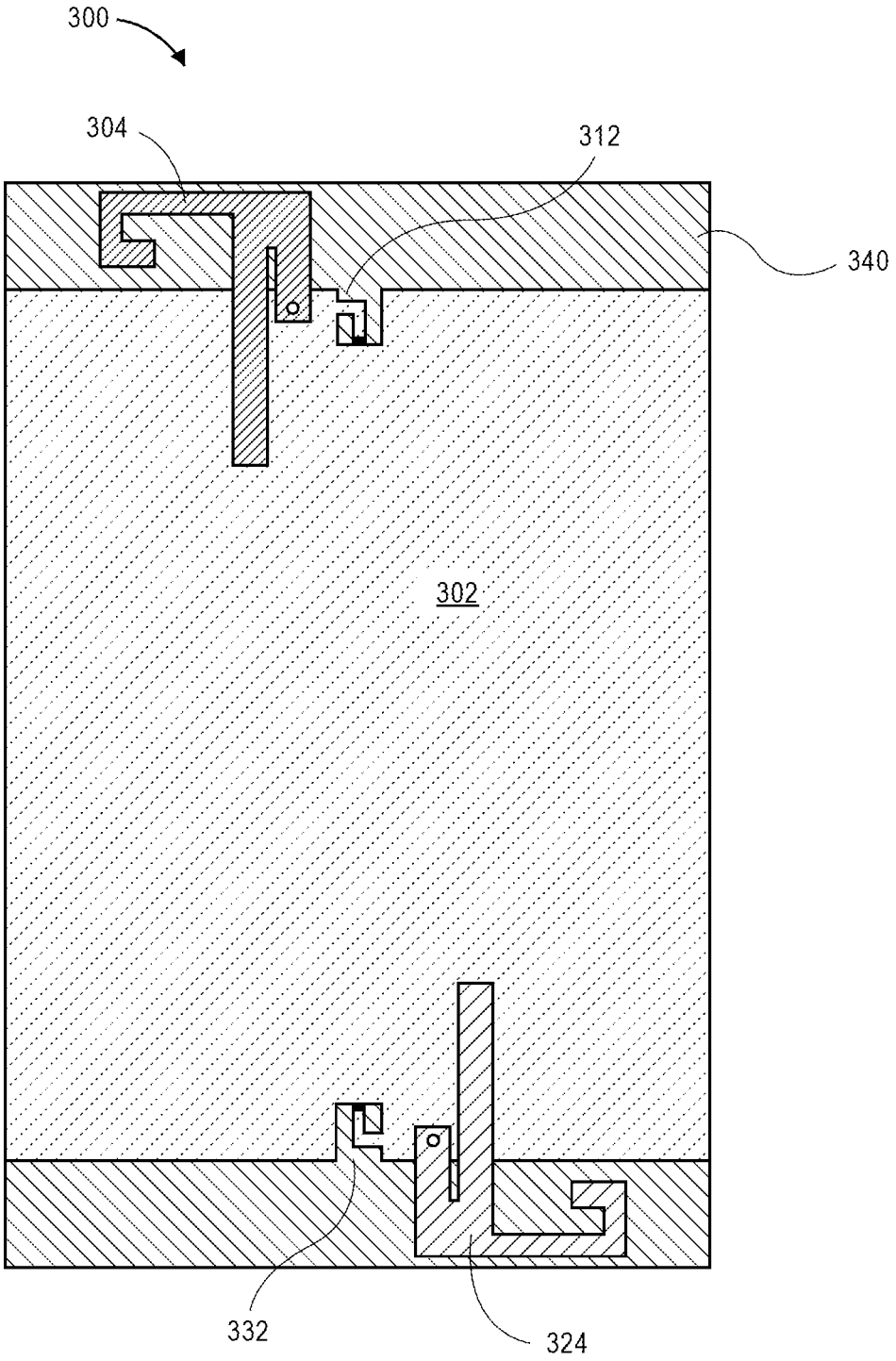
FIG. 3A is a top view of inverted F antennas with decoupling apparatus inlaid within a ground plane in accordance with an embodiment.
Figure 3B:
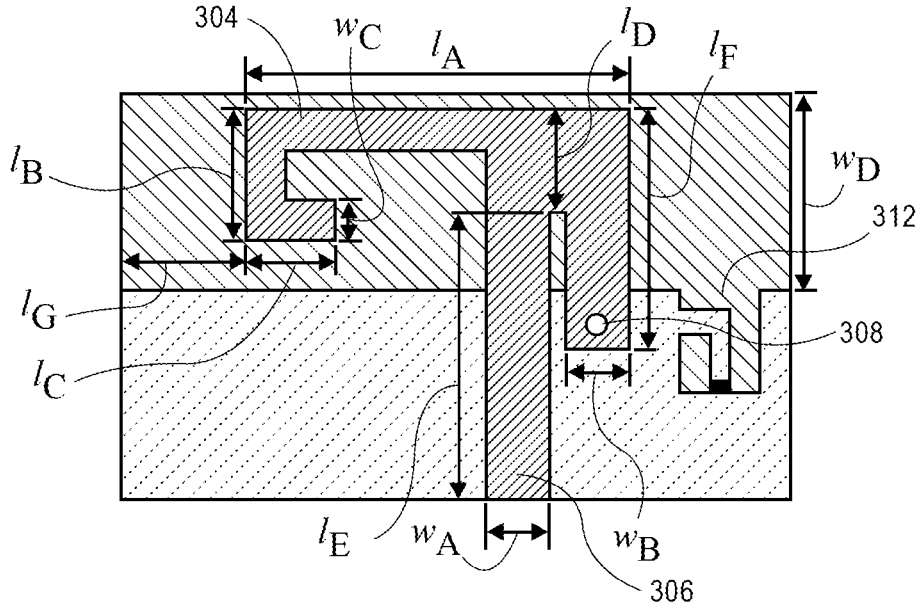
FIG. 3B is a close in view one of the antennas and decoupling apparatus of FIG. 3A.
Figure 3C:
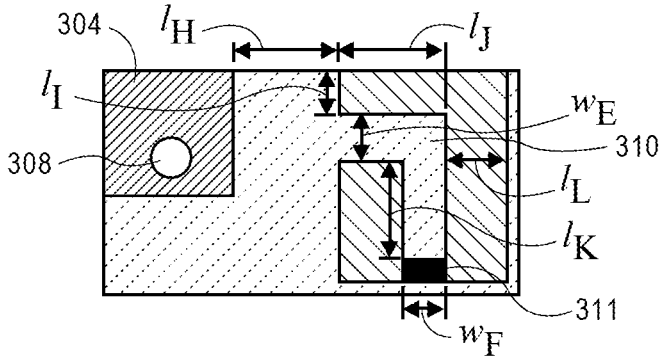
FIG. 3C is a close in view of the decoupling apparatus of FIG. 3B.

FIGS. 3A-3C illustrate inverted F antennas (IFAs) with decoupling apparatus inlaid within a ground plane.

In FIG. 3A, system 300 has two IFAs 304 and 324 mounted on the two opposite edges of a phone sized PCB board. Electrically shallow openings 312 and 332 are cut from the edge of ground plane 302 and a short stub is stretched from a fringe of each opening. Antennas 304 and 324 are supported by ground plane 302 and dielectric 340 that extends laterally from edges of the ground plane. The dimension of the openings should be electrically very small to ensure the influence of the opening and the stub on original attributes of the antennas is negligible.

FIG. 3B is a close up view of the antenna 304 with feeding port 306 and shorting end 308 on the shorting arm. Reentrant opening 312 is near shorting end 308.

FIG. 3C is a further close up of the shorting arm of antenna 304 with aperture 312 nearby. Stub 310 projects from the side of the aperture nearest shorting end 308 and then turns downward toward the center of the ground plane. Lumped capacitor element 311 is soldered between an end of stub 310 and an edge of the aperture to the ground plane.

In the embodiment, the two IFAs are in long-term evolution (LTE) band 1 (2.11-2.17 GHz). Dimensions of the exemplary IFA and reentrant opening are marked with reference identifiers $l_1$, $w_1$, $l_A$–$l_L$, and $w_A$–$w_F$. Specific values are shown in Table 1. Measured performance improvements are shown in Table 2.

With the specific numerical dimensions in Table 1, a set of optimal solutions for capacitive loads can to be sought. This searching process can be carried out graphically, such as with a contour plot for the mutual coupling $S_{21}$ at 2.14 GHz with respect to capacitor 311 and the capacitor near the other antenna. It can be found that for a given allowable mutual coupling level, say −20 dB, there is a solution range for the two capacitors, which are not necessary equal even for two symmetric antennas.

The definition of the objective function can be flexible. For example, the highest mutual coupling in the band from 2.13 to 2.15 GHz can be collected. For the same mutual coupling level, the solution range for decoupling in a frequency band is narrower than that for decoupling at a single frequency point, say 2.14 GHz.

When distance $l_H$ (i.e., the distance between the shorting leg and aperture) is changed from 2.5 to 6 mm, the solution range for the two capacitors can be narrower and the achievable minimum mutual coupling level is higher. It can be concluded that the position of the opening plays an important role in decoupling using this decoupling method.

One should find an optimal position for a wider solution region, which also leads to a wider decoupling frequency band. It is understandable that when the length becomes smaller, the capacitor values become larger. In some simulations, the real part of the loads for the capacitors is assumed to be 0.148Ω, although the value is not sensitive to the solution region.

Figure 4A:
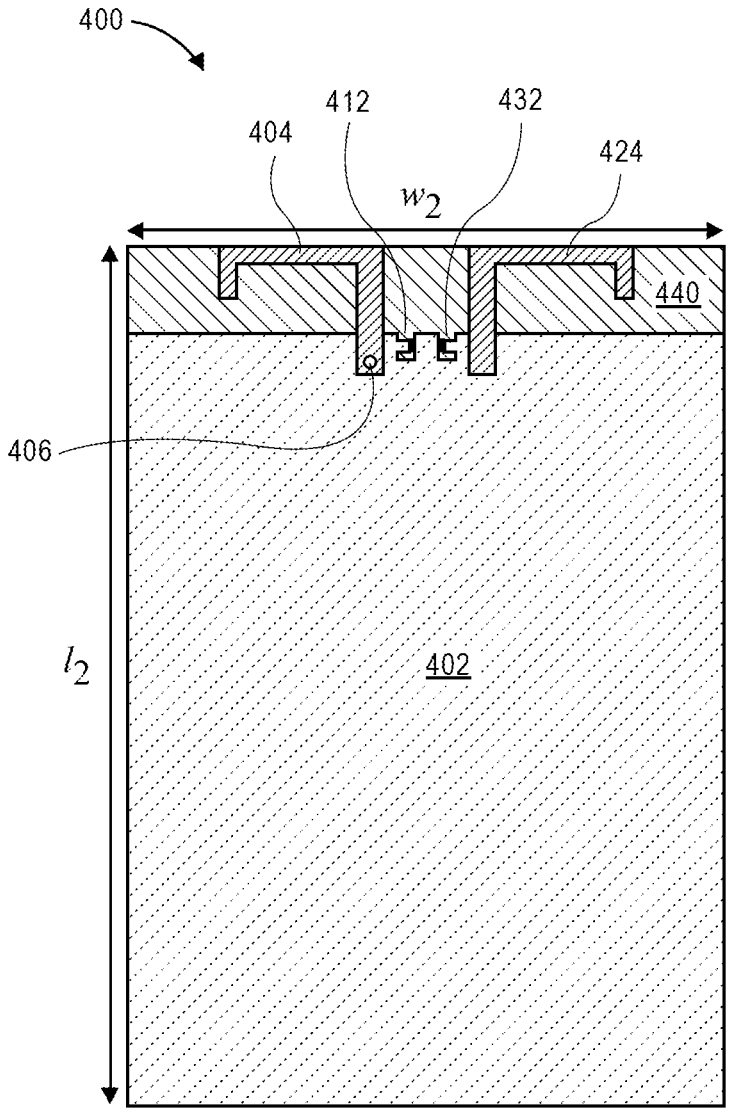
FIG. 4A is a top view of bent monopole antennas with decoupling apparatus inlaid within a ground plane in accordance with an embodiment.
Figure 4B:
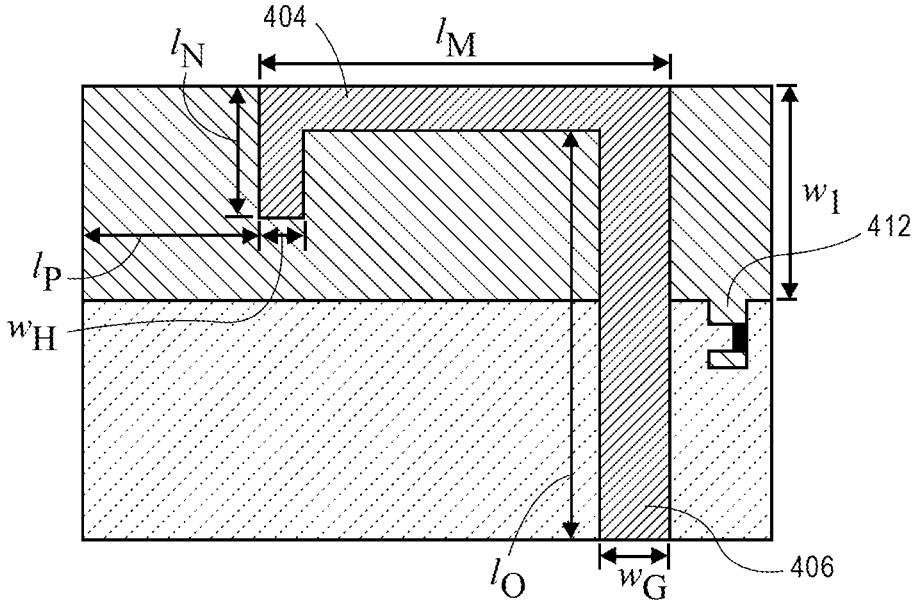
FIG. 4B is a close in view of one of the antennas and decoupling apparatus of FIG. 4A.
Figure 4C:
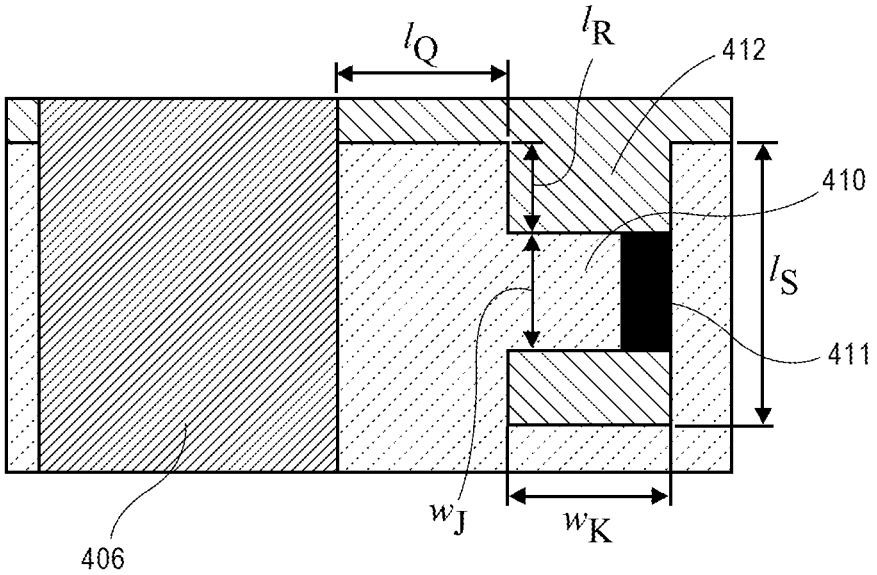
FIG. 4C is a close in view of the decoupling apparatus of FIG. 4B.

FIGS. 4A-4C illustrate bent monopole antennas with decoupling apparatus inlaid within a ground plane. Monopole antennas are widely used in mobile terminals due to their low profile, compact size, and convenience of layout.

In FIG. 4A, system 400 has two monopole antennas 404 and 424 mounted on the top edge of a PCB board, symmetrically. Electrically shallow openings 412 and 432 are cut from the edge of ground plane 402, and a short, straight stub extends from one edge to an opposite edge of the opening. Antennas 404 and 424 are supported by ground plane 402 and dielectric 440 that extends laterally from edges of the ground plane.

FIG. 4B is a close up view of the left antenna 404 with feeding port 406. Reentrant opening 412 is near feeding port 406.

FIG. 4C is a further close up of the feeding port arm of antenna 404 with aperture 412 nearby. Stub 410 projects from the side of the aperture nearest feeding port 404 and extends straight out. Lumped capacitor element 411 is soldered between an end of stub 410 and an edge of the aperture to the ground plane.

The dimensions of the exemplary monopole antenna as well as a reentrant opening for inlaying a decoupling capacitor are marked with reference identifiers $l_2$, $w_2$, $l_M$–$l_S$ and $w_G$–$w_K$. Specific values are shown in Table 1.

With the specific numerical dimensions in the table, and assuming real parts of the impedances of the capacitors are 0.106Ω, two decoupling capacitors with a value of 3 pF have been experimentally shown to improve isolation between the loop antennas from about 7 to 30 dB at 2.14 GHz, and the matching condition is, interestingly, improved.

As summarized in Table 2, the measured total efficiencies at 2.14 GHz is improved from 57 to 73% after decoupling. The average throughputs for the LTE module with the coupled and decoupled loop antennas are measured under the UMi and UMa environments, respectively. In the UMi channel environment, when throughput drops 10% from the maximum value of 33.356 Mbps, about 0.4 dB or 9% of power saving, can be achieved after decoupling. Similarly, under the UMa channel environment, about 0.9 dB power saving can be achieved when the throughput drops from the maximum value 14.386 Mbps to 13 Mbps. Similar to the case of IFAs, the shape of the radiation patterns does not change significantly after decoupling. Gain improvement is noticeable.

Figure 5:
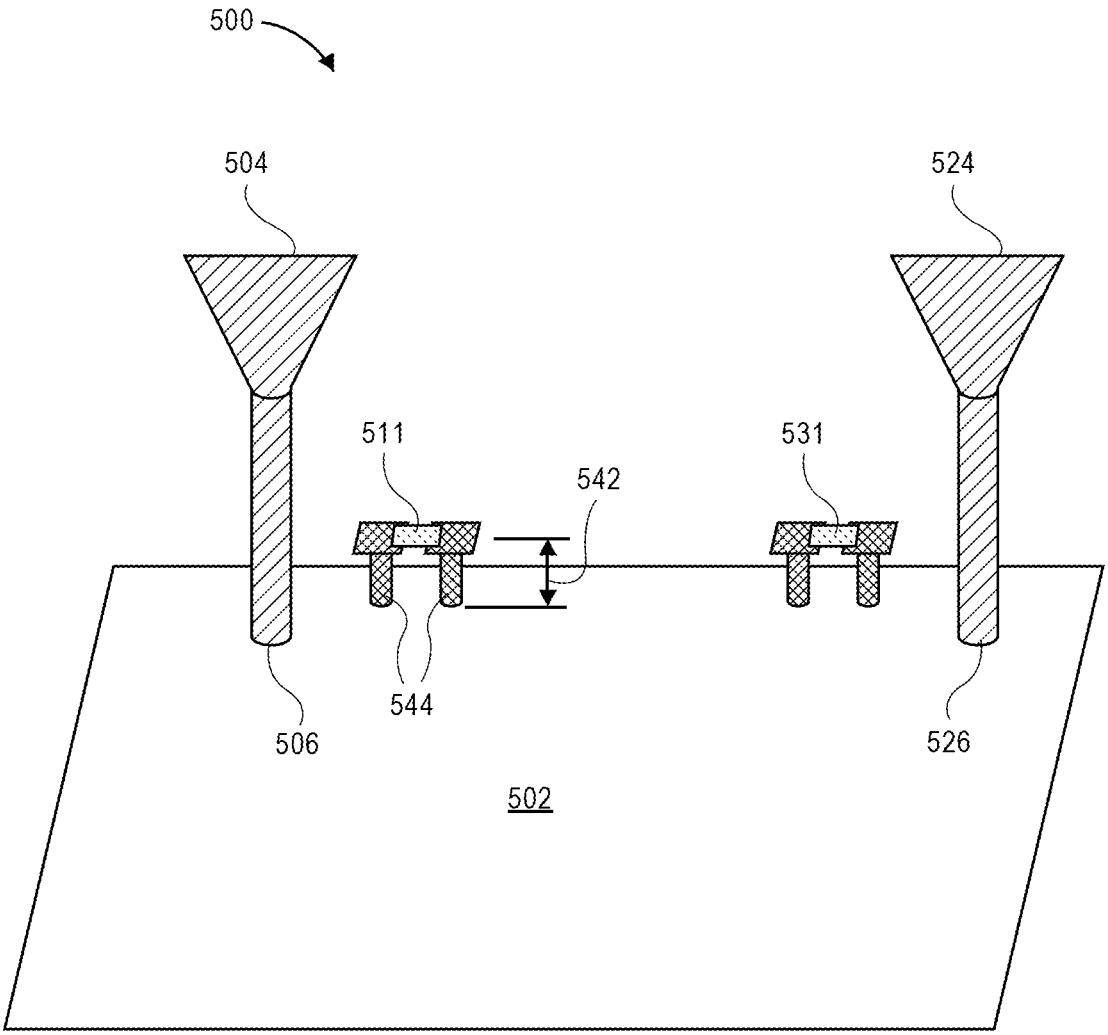
FIG. 5 illustrates soldering pad decoupling apparatus raised above a ground plane in accordance with an embodiment.

FIG. 5 illustrates soldering pad decoupling apparatus raised above a ground plane. In system 500, antennas 504 and 524 are connected through ground plane 502 at feeding ports 506 and 526.

Instead of capacitors inlaid within the ground plane, stubs 544 protrude above ground plane 502 by distance 542. Stubs 544, which are essentially soldering pads raised above the ground plane, are connected by capacitor 511. The stubs extend no more than 0.1λ from the ground plane, and they are located within 0.2λ of feeding port 506 of antenna 504.

Similarly, another set of stubs are joined by capacitor 531 within 0.2 λ2 of feeding port 506 of antenna 524.

No feature of the protrusions is greater than 0.2λ in order to remain electrically shallow. Properly located, stub protrusions 544 and capacitors 511 generate a signal from the currents near feeding port 506 of the same magnitude yet opposite phase of that of a coupling current between antennas 504 and 524. The generated signal largely cancels the coupling current at victim port 526 of antenna 524.

Figure 6:
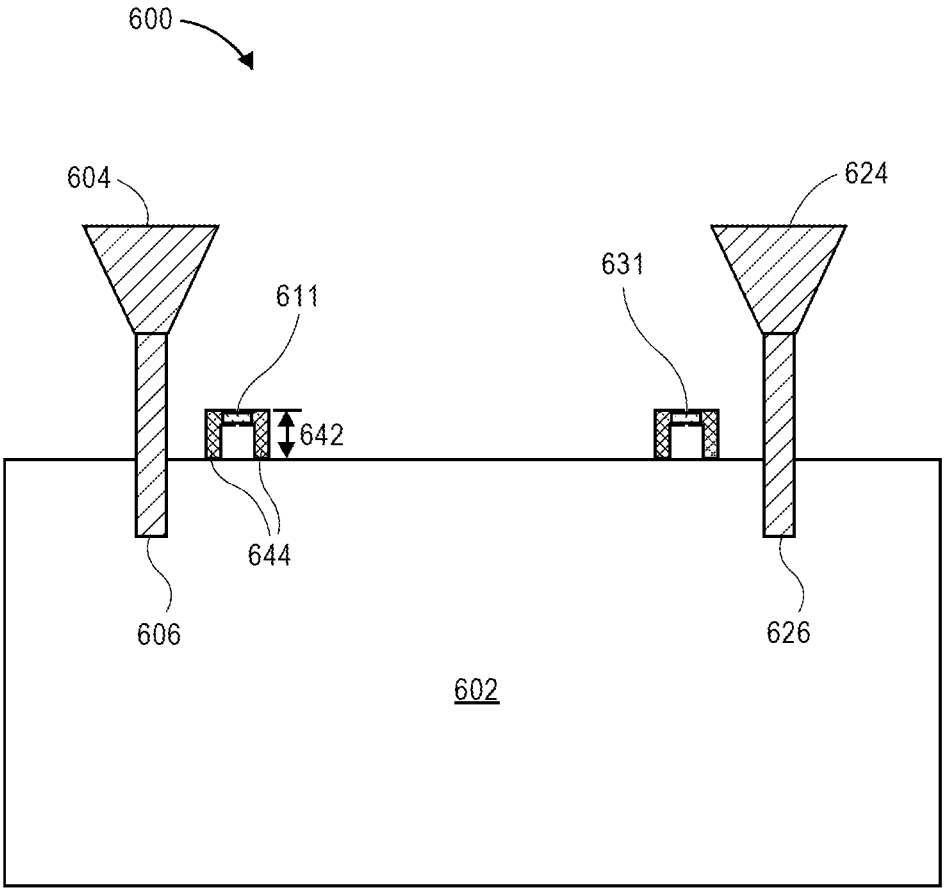
FIG. 6 illustrates decoupling apparatus protruding laterally in the same plane as a ground plane in accordance with an embodiment.

FIG. 6 illustrates decoupling apparatus protruding laterally in the same plane as a ground plane. In system 600, antennas 604 and 624 are connected through ground plane 602 at feeding ports 606 and 626.

Protrusions 644 extend laterally, in the same plane as the ground plane, from an edge of ground plane 602. The protrusions extend no more than 0.1λ from the ground plane, and they are located within 0.2λ of the feeding port 606 of antenna 604.

Similarly, another set of stubs are joined by capacitor 631 within 0.2 λ2 of feeding port 626 of antenna 624. No feature of the protrusions is greater than 0.2 λ2.

FIGS. 7-10 illustrate different embodiments of apertures and stubs near the shorting end of an IFA antenna. These aperture and stub configurations are applicable to other antenna types, such as loop and monopole antennas. These configurations are a sample of different design configurations that can be used in different embodiments.

Figure 7:
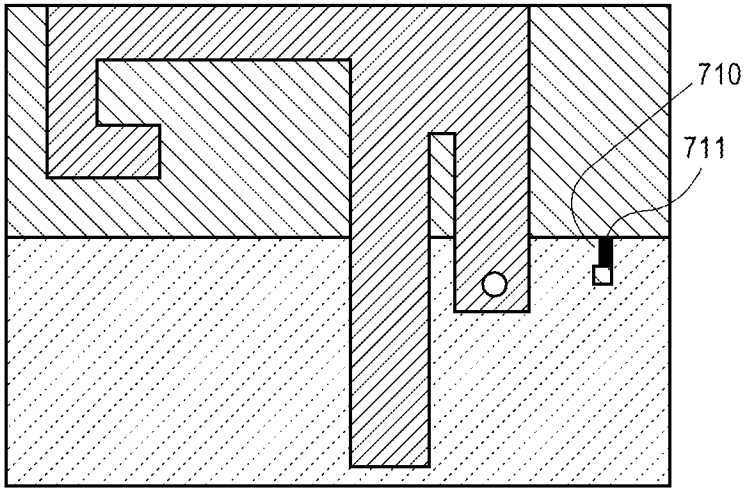
FIG. 7 illustrates a stub that is aligned and even with a side of a ground plane in accordance with an embodiment.

FIG. 7 illustrates stub 710 that is aligned and even with a side of a ground plane. That is, an outer edge of the stub is just the outer edge of the ground plane. The aperture, and not the stub, is L-shaped. Capacitor 711 extends from the end of stub 710 to an opposite side of the aperture.

Figure 8:
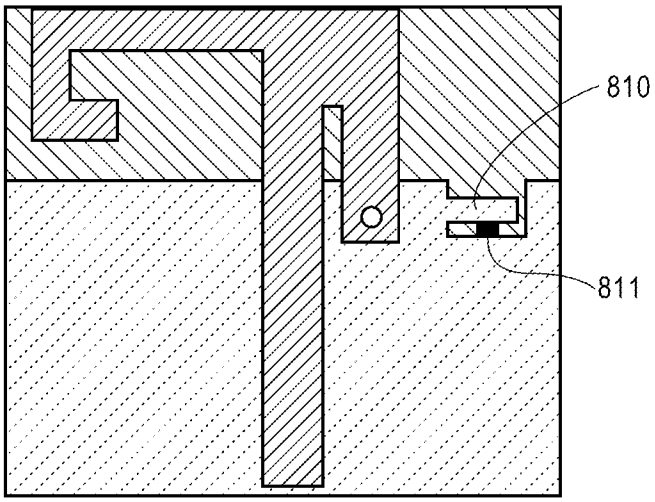
FIG. 8 illustrates a capacitor not on the end of a stub in accordance with an embodiment.

FIG. 8 illustrates straight stub 810 with capacitor 811 off to one side. That is, capacitor 811 is not connected at the end of stub 810, but rather the side of the stub. This shows that a capacitor does not need to be at the end of the stub. But the capacitor should have one end electrically connected with the stub and the other end electrically connected with the ground plane.

Figure 9:
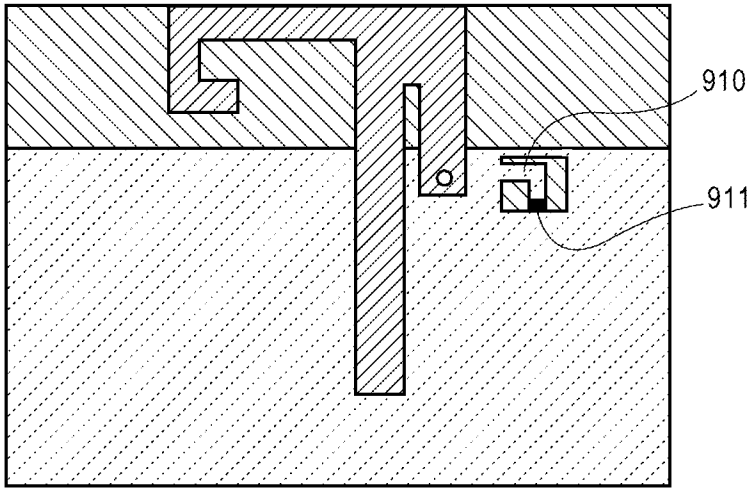
FIG. 9 illustrates an L-shaped stub in an interior hole of a ground plane in accordance with an embodiment.

FIG. 9 illustrates L-shaped stub 910 in an interior hole of a ground plane. That is, the hole or aperture is not reentrant. Capacitor 911 extends from an end of stub 910 to a side of the hole.

Figure 10:
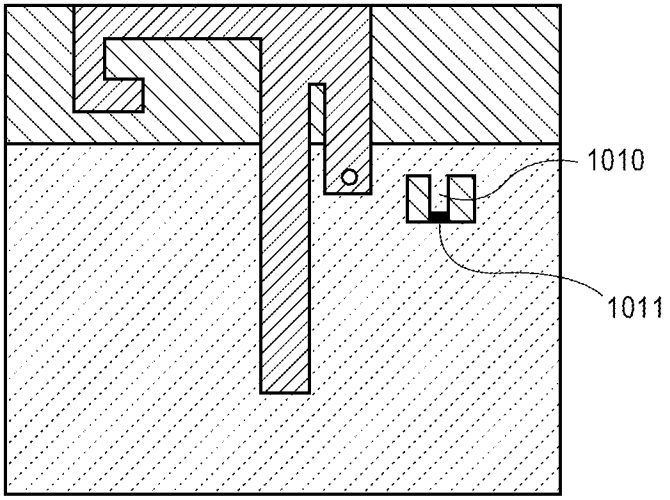
FIG. 10 illustrates a straight stub in an interior hole of a ground plane in accordance with an embodiment.

FIG. 10 illustrates straight stub 1010 in an interior hole of a ground plane. Like in the previous figure, the hole is not reentrant. Capacitor 1011 extends from an end of stub 1010 to a side or fringe of the hole.

For the interior hole configurations in FIGS. 9-10, it is found that the decoupling effect still exists but performance is not very good as compared to the cases in which the cut is made from the edge of the ground plane. That is, reentrant apertures appear to have better decoupling performance.

Figure 11:
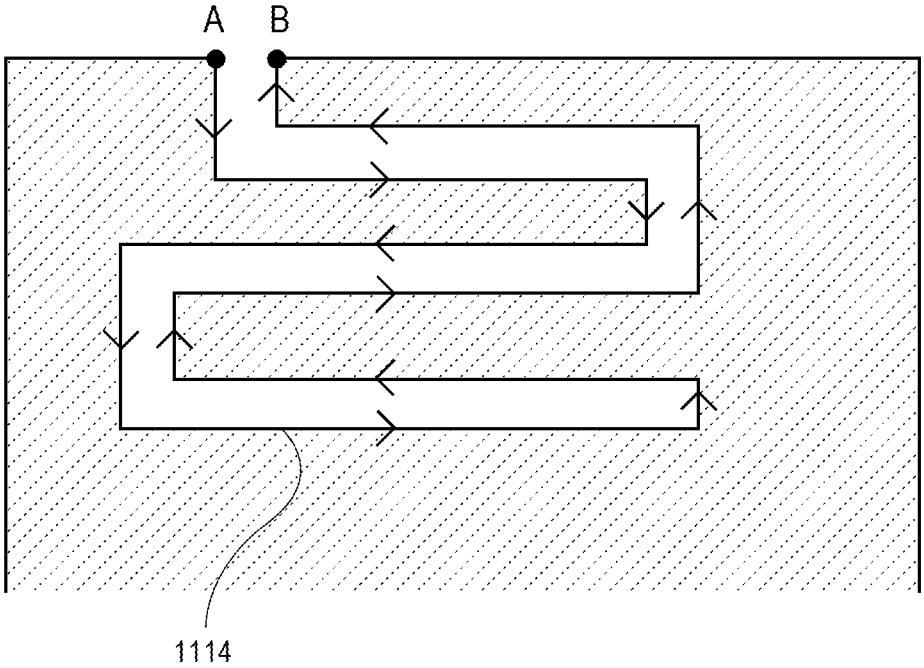
FIG. 11 illustrates an aperture with a long continuous edge of the prior art.

FIG. 11 illustrates aperture 1114, or slot, in a ground plane with a long continuous edge of the prior art. Although the slot is serpentine with several 90 degree bends, its edge is continuous. As shown in the figure, the "continuous edge" of the aperture extends uninterrupted from point A to point B. This long continuous edge, or discontinuity between the metal of the ground plane and the air or dielectric in the slot, could be resonant with antenna frequencies if it is on the order of ¼ λ or more.

For embodiments of the present application, it has been found that avoiding long slots with continuous edges, and keeping edges and features less than 0.1λ, is less likely to negatively affect antenna performance.

Figure 12:
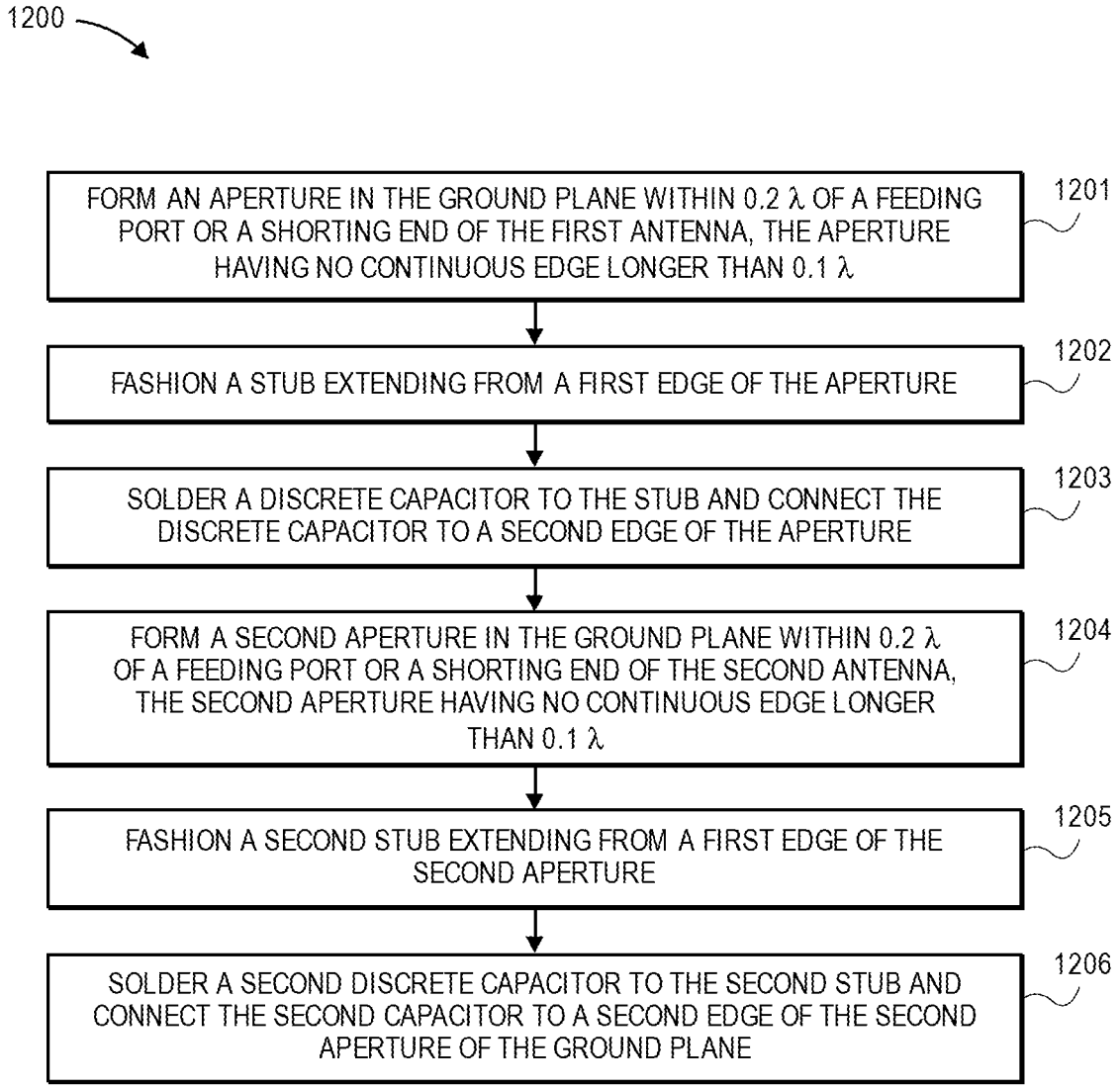
FIG. 12 is a flowchart illustrating a process according to an embodiment of the present disclosure.

FIG. 12 is a flowchart of process 1200 in accordance with an embodiment. In operation 1201, an aperture in the ground plane is formed within 0.2λ of a feeding port or a shorting end of a first antenna, the aperture having no continuous edge longer than 0.1λ. In operation 1202, a stub extending from a first edge of the aperture is fashioned. In operation 1203, a discrete capacitor is soldered to the stub, and the capacitor is connected to a second edge of the aperture. In operation 1204, a second aperture is formed in the ground plane within 0.2 λ2 of a feeding port or a shorting end of the second antenna, the second aperture having no continuous edge longer than 0.1 λ2. In operation 1205, a second stub extending from a first edge of the second aperture is fashioned. In operation 1206, a second discrete capacitor is soldered to the second stub, and the second capacitor is connected to a second edge of the second aperture of the ground plane. One can mill or etch metal on a PCB for the forming and fashioning.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. An antenna decoupling apparatus for antennas that share a ground plane, the apparatus comprising:

a first antenna having an operative wavelength λ;

a second antenna;

a ground plane connecting the first antenna and the second antenna, the ground plane having an aperture located within 0.2λ of a feeding port or a shorting end of the first antenna, the aperture having no continuous edge longer than 0.1λ;

a stub extending from a first edge of the aperture and turning toward a geometric center of the ground plane to form an L shape; and a discrete capacitor connecting the stub to a second edge of the aperture.

2. The apparatus of claim 1 wherein the aperture is a reentrant opening extending from a periphery of the ground plane.

3. The apparatus of claim 1 wherein the aperture is a first aperture and the ground plane has a second aperture located within 0.2λ of a feeding port or a shorting end of the second antenna, the second aperture having no continuous edge longer than 0.1λ, the apparatus further comprising:

a second stub extending from a first edge of the second aperture; and a second discrete capacitor connecting the second stub to a second edge of the second aperture.

4. The apparatus of claim 3 wherein the second aperture is a reentrant opening extending from a periphery of the ground plane.

5. The apparatus of claim 1 wherein the first antenna includes an inverted F antenna (IFA), and the aperture is located within 0.2λ of a shorting end of the IFA.

6. The apparatus of claim 1 wherein the first antenna includes a bent monopole antenna, and the aperture is located within 0.2λ of a feeding port of the bent monopole antenna.

7. The apparatus of claim 1 wherein the first antenna includes a loop antenna, and the aperture is located within 0.2λ of a feeding port of the loop antenna.

8. The apparatus of claim 1 wherein the first and second antennas comprise an inverted F antenna (IFA), monopole antenna, or loop antenna.

9. The apparatus of claim 1 wherein the first antenna or the second antenna comprises a metal frame of a mobile electronic device.

10. The apparatus of claim 1 wherein the discrete capacitor is a variable capacitor.

11. The apparatus of claim 1 wherein the discrete capacitor is a surface mount device (SMD) capacitor.

12. The apparatus of claim 1 wherein the discrete capacitor is a first capacitor, the apparatus further comprising:

another discrete capacitor in parallel with the first capacitor.

13. The apparatus of claim 1 further comprising:

a printed circuit board (PCB) dielectric supporting the ground plane, the first antenna, and the second antenna and filling the aperture.

14. The apparatus of claim 1 wherein the discrete capacitor is directly connected to the ground plane at the second edge of the aperture.

15. The apparatus of claim 1 wherein the discrete capacitor is connected at an end of the stub.

16. The apparatus of claim 1 wherein the first and second antennas share operating frequency bands or are in two adjacent frequency bands.

17. The apparatus of claim 1 wherein a portion of the stub that extends from the first edge of the aperture is inset from a perimeter of the ground plane.

18. A method for reducing coupling between a first antenna and a second antenna that share a ground plane, the method comprising:

forming an aperture in the ground plane within 0.2λ of a feeding port or a shorting end of the first antenna, the aperture having no continuous edge longer than 0.1λ;

fashioning a stub extending from a first edge of the aperture and turning toward a geometric center of the ground plane to form an L shape; and soldering a discrete capacitor to the stub and connecting the discrete capacitor to a second edge of the aperture.

19. The method of claim 18 wherein the aperture is a reentrant opening extending from a periphery of the ground plane.

20. The method of claim 18 wherein the aperture is a first aperture, the method further comprising:

forming a second aperture in the ground plane within 0.2λ of a feeding port or a shorting end of the second antenna, the second aperture having no continuous edge longer than 0.1λ;

fashioning a second stub extending from a first edge of the second aperture; and soldering a second discrete capacitor to the second stub and connecting the second stub to a second edge of the second aperture of the ground plane.

21. The method of claim 20 wherein the second aperture is a reentrant opening extending from a periphery of the ground plane.

22. The method of claim 18 further comprising:

modeling the dimensions of the first and second antennas, ground plane, aperture, and stub using electromagnetic (EM) simulation software; and selecting a capacitance of the discrete capacitor based on the modeling.

23. The method of claim 18 further comprising:

providing a printed circuit board (PCB) dielectric; and milling or etching metal on the PCB for the forming and fashioning.

24. The method of claim 18 wherein the stub is fashioned to extend from the first edge of the aperture at an inset distance from a perimeter of the ground plane.

25. An antenna decoupling apparatus for antennas that share a ground plane, the apparatus comprising:

a first antenna having an operative wavelength λ;

a second antenna;

a ground plane connecting the first antenna and the second antenna, the ground plane having an aperture located within 0.2λ of a feeding port or a shorting end of the first antenna, the aperture having no continuous edge longer than 0.1λ;

an L-shaped stub extending from a first edge of the aperture, wherein a portion of the L-shaped stub that extends from the first edge of the aperture is inset from a perimeter of the ground plane; and a discrete capacitor connecting the L-shaped stub to a second edge of the aperture.

26. The apparatus of claim 25 wherein the aperture is a first aperture and the ground plane has a second aperture located within 0.2λ of a feeding port or a shorting end of the second antenna, the second aperture having no continuous edge longer than 0.1λ, the apparatus further comprising:

a second stub extending from a first edge of the second aperture; and a second discrete capacitor connecting the second stub to a second edge of the second aperture.

27. The apparatus of claim 25 further comprising:

a printed circuit board (PCB) dielectric supporting the ground plane, the first antenna, and the second antenna and filling the aperture.

28. A method for reducing coupling between a first antenna and a second antenna that share a ground plane, the method comprising:

forming an aperture in the ground plane within 0.2λ of a feeding port or a shorting end of the first antenna, the aperture having no continuous edge longer than 0.1λ;

fashioning an L-shaped stub extending from a first edge of the aperture at an inset distance from a perimeter of the ground plane; and soldering a discrete capacitor to the L-shaped stub and connecting the discrete capacitor to a second edge of the aperture.

29. The method of claim 28 wherein the aperture is a first aperture, the method further comprising:

forming a second aperture in the ground plane within 0.2λ of a feeding port or a shorting end of the second antenna, the second aperture having no continuous edge longer than 0.1λ;

fashioning a second stub extending from a first edge of the second aperture; and soldering a second discrete capacitor to the second stub and connecting the second stub to a second edge of the second aperture of the ground plane.

30. The method of claim 28 further comprising:

providing a printed circuit board (PCB) dielectric; and milling or etching metal on the PCB for the forming and fashioning.

* * * * *